US007493708B2

(12) United States Patent
Crowley, Jr.

(10) Patent No.: US 7,493,708 B2
(45) Date of Patent: Feb. 24, 2009

(54) ARTICLE OF FOOTWEAR WITH PLATE DIVIDING A SUPPORT COLUMN

(75) Inventor: Gerald Edwin Crowley, Jr., Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 552 days.

(21) Appl. No.: 11/060,853

(22) Filed: Feb. 18, 2005

(65) Prior Publication Data

US 2006/0185191 A1 Aug. 24, 2006

(51) Int. Cl.
*A43B 13/18* (2006.01)

(52) U.S. Cl. ..... 36/28; 36/103; D2/946

(58) Field of Classification Search ..... 36/27, 36/28, 88, 140, 144, 145, 146, 150, 35 R; D2/964
See application file for complete search history.

(56) References Cited

U.S. PATENT DOCUMENTS

| | | | |
|---|---|---|---|
| 507,490 | A | 10/1893 | Gambino |
| 607,086 | A | 7/1898 | Safford |
| 622,673 | A | 4/1899 | Ferrata |
| 933,422 | A | 9/1909 | Dee |
| 949,754 | A | 2/1910 | Busky |
| 1,094,211 | A | 4/1914 | Jenoi et al. |
| 1,099,180 | A | 6/1914 | Karacsonyi |
| 1,102,343 | A | 7/1914 | Kovacs |
| 1,272,490 | A | 7/1918 | Matear |
| 1,278,320 | A | 9/1918 | Ellithorpe |
| 1,338,817 | A | 5/1920 | DeLuca |
| 1,502,087 | A | 7/1924 | Bunns |
| 1,670,747 | A | 5/1928 | Sestito |
| 1,870,065 | A | 8/1932 | Nusser |
| 1,870,114 | A | 8/1932 | Heller |
| 2,104,924 | A | 1/1938 | Dellea |
| 2,122,108 | A | 6/1938 | Modlin |
| 2,198,228 | A | 4/1940 | Pinaud et al. |
| 2,299,009 | A | 10/1942 | Denk |
| 2,437,227 | A | 3/1948 | Hall |

(Continued)

FOREIGN PATENT DOCUMENTS

| | | |
|---|---|---|
| CH | 570 130 | 9/1974 |

(Continued)

OTHER PUBLICATIONS

Article entitled "Hoop Dreams" (Applicant does not know the date of publication; however, it is believed that the publication date for this reference is at least one year prior to the Jan. 8, 2003 filing date for the present application), 1 page.

(Continued)

*Primary Examiner*—Jila M Mohandesi
(74) *Attorney, Agent, or Firm*—Banner & Witcoff, Ltd.

(57) ABSTRACT

An article of footwear includes an upper, a midsole secured to the upper, and a support assembly secured to the midsole. The support assembly includes a top plate, a bottom plate, and a plurality of elastomeric support columns secured to the top plate and the bottom plate. The bottom plate extends through at least one of the support columns such that at least a portion of the respective support column extends outwardly from the bottom plate. An outsole is secured to the bottom plate.

24 Claims, 4 Drawing Sheets

U.S. PATENT DOCUMENTS

| | | | | |
|---|---|---|---|---|
| 2,710,460 | A | | 6/1955 | Stasinos |
| 2,721,400 | A | | 10/1955 | Israel |
| 3,041,746 | A | | 7/1962 | Rakus |
| 3,429,545 | A | | 2/1969 | Michel |
| 3,822,490 | A | | 7/1974 | Murawski |
| 4,000,566 | A | | 1/1977 | Famolare, Jr. |
| 4,030,213 | A | | 6/1977 | Daswick |
| 4,074,446 | A | | 2/1978 | Eisenberg |
| 4,223,457 | A | | 9/1980 | Borgeas |
| 4,237,625 | A | | 12/1980 | Cole et al. |
| 4,241,523 | A | | 12/1980 | Daswick |
| 4,262,433 | A | | 4/1981 | Hagg et al. |
| 4,267,648 | A | | 5/1981 | Weisz |
| 4,271,606 | A | | 6/1981 | Rudy |
| 4,271,607 | A | | 6/1981 | Funck |
| 4,314,413 | A | | 2/1982 | Dassler |
| 4,319,412 | A | | 3/1982 | Muller et al. |
| 4,342,158 | A | | 8/1982 | McMahon et al. |
| 4,364,188 | A | | 12/1982 | Turner |
| 4,391,048 | A | * | 7/1983 | Lutz ..... 36/28 |
| 4,399,621 | A | | 8/1983 | Dassler |
| 4,439,936 | A | | 4/1984 | Clarke et al. |
| 4,492,046 | A | | 1/1985 | Kosova |
| 4,494,321 | A | | 1/1985 | Lawlor |
| 4,535,553 | A | | 8/1985 | Derderian |
| 4,536,974 | A | | 8/1985 | Cohen |
| 4,546,555 | A | | 10/1985 | Spademan |
| 4,559,366 | A | | 12/1985 | Hostettler |
| 4,566,206 | A | | 1/1986 | Weber |
| 4,592,153 | A | | 6/1986 | Jacinto |
| 4,594,799 | A | | 6/1986 | Lin |
| 4,598,484 | A | | 7/1986 | Ma |
| 4,598,487 | A | | 7/1986 | Misevich |
| 4,610,099 | A | | 9/1986 | Signori |
| 4,616,431 | A | | 10/1986 | Dassler |
| 4,624,062 | A | | 11/1986 | Autry |
| 4,638,575 | A | | 1/1987 | Illustrato |
| 4,638,577 | A | | 1/1987 | Riggs |
| 4,660,299 | A | | 4/1987 | Omilusik |
| 4,680,875 | A | | 7/1987 | Danieli |
| 4,680,876 | A | | 7/1987 | Peng |
| 4,709,489 | A | | 12/1987 | Welter |
| 4,715,130 | A | | 12/1987 | Scatena |
| 4,722,131 | A | | 2/1988 | Huang |
| 4,731,939 | A | | 3/1988 | Parracho et al. |
| 4,733,483 | A | | 3/1988 | Lin |
| 4,746,555 | A | | 5/1988 | Luckanuck |
| 4,753,021 | A | | 6/1988 | Cohen |
| 4,774,774 | A | | 10/1988 | Allen, Jr. |
| D298,583 | S | | 11/1988 | Yung-Mao |
| 4,794,707 | A | | 1/1989 | Franklin et al. |
| 4,798,009 | A | | 1/1989 | Colonel et al. |
| 4,802,289 | A | | 2/1989 | Guldager |
| 4,815,221 | A | | 3/1989 | Diaz |
| 4,843,737 | A | | 7/1989 | Vorderer |
| 4,843,741 | A | | 7/1989 | Yung-Mao |
| 4,845,863 | A | | 7/1989 | Yung-Mao |
| 4,878,300 | A | | 11/1989 | Bogaty |
| 4,881,328 | A | | 11/1989 | Yung-Mao |
| 4,881,329 | A | | 11/1989 | Crowley |
| 4,887,367 | A | | 12/1989 | Mackness et al. |
| 4,905,382 | A | | 3/1990 | Yung-Mao |
| 4,908,962 | A | | 3/1990 | Yung-Mao |
| 4,910,884 | A | | 3/1990 | Lindh et al. |
| 4,918,838 | A | | 4/1990 | Chang |
| 4,936,029 | A | | 6/1990 | Rudy |
| 4,956,927 | A | | 9/1990 | Misevich et al. |
| 4,984,376 | A | | 1/1991 | Walter et al. |
| D315,634 | S | | 3/1991 | Yung-Mao |
| 5,005,300 | A | | 4/1991 | Diaz et al. |
| 5,014,449 | A | | 5/1991 | Richard et al. |
| 5,068,981 | A | | 12/1991 | Jung |
| 5,092,060 | A | | 3/1992 | Frachey et al. |
| 5,138,776 | A | | 8/1992 | Levin |
| 5,222,312 | A | | 6/1993 | Doyle |
| 5,233,767 | A | | 8/1993 | Kramer |
| 5,343,639 | A | | 9/1994 | Kilgore et al. |
| 5,353,523 | A | | 10/1994 | Kilgore et al. |
| 5,572,804 | A | | 11/1996 | Skaja et al. |
| 5,685,090 | A | | 11/1997 | Tawney et al. |
| 5,782,014 | A | | 7/1998 | Peterson |
| 5,853,844 | A | | 12/1998 | Wen |
| 5,976,451 | A | | 11/1999 | Skaja et al. |
| 6,018,889 | A | | 2/2000 | Friton |
| 6,055,747 | A | | 5/2000 | Lombardino |
| 6,115,944 | A | | 9/2000 | Lain |
| 6,131,310 | A | | 10/2000 | Fang |
| D433,216 | S | | 11/2000 | Avar et al. |
| 6,233,846 | B1 | | 5/2001 | Sordi |
| 6,305,100 | B1 | | 10/2001 | Komarnycky et al. |
| 6,457,261 | B1 | | 10/2002 | Crary |
| 6,722,058 | B2 | | 4/2004 | Lucas et al. |
| 6,775,930 | B2 | * | 8/2004 | Fuerst ..... 36/103 |
| 6,842,999 | B2 | * | 1/2005 | Russell ..... 36/28 |

FOREIGN PATENT DOCUMENTS

| | | | |
|---|---|---|---|
| DE | 806 647 | | 2/1949 |
| DE | 1 485 654 | | 1/1965 |
| DE | 3400997 | | 7/1985 |
| ES | 2 080 933 | | 1/1990 |
| ES | 1 036 287 | | 1/1997 |
| FR | 465.267 | | 4/1914 |
| FR | 1.227.420 | | 4/1960 |
| FR | 2 556 188 | | 6/1985 |
| GB | 21594 | | 7/1903 |
| GB | 7163 | | 10/1906 |
| GB | 2 032 761 | | 5/1980 |
| GB | 2 173 987 | A | 10/1986 |
| JP | 146188 | | 11/1990 |
| SU | 1526637 | A1 | 12/1989 |

OTHER PUBLICATIONS

Advertisement for Aura "Introducing the exciting new performance driven 2001 Aura," 1 page.

Web page translation using babelfish, entitled "The tennis shoe with the motivating force" (Applicant does not know the date of publication; however, it is believed that the publication date for this reference is at least one year prior to the Jan. 8, 2003 filing date for the present application), 2 pages.

FWN, vol. 46, No. 38, Sep. 17, 1990, "Marco Scatena puts spring in Athlon wearers' control," 1 page.

Spring- and Shock Absorber Bearing Spring Elements Springing Comfort with High Damping (Applicant does not know the date of publication; however, it is believed that the publication date for this reference is at least one year prior to the Jan. 8, 2003 filing date for the present application), 3 pages.

Activ Power Spring System catalog, front and back pages with English translation of back page, 3 pages.

US 4,974,345, 12/1990, Yung-Mao (withdrawn)

* cited by examiner

ARTICLE OF FOOTWEAR WITH PLATE DIVIDING A SUPPORT COLUMN

FIELD OF THE INVENTION

This invention relates generally to an article of footwear, and, in particular, to an article of footwear having support columns and a plate dividing at least one of the support columns.

BACKGROUND OF THE INVENTION

A conventional article of athletic footwear includes two primary elements, an upper and a sole assembly. The upper provides a covering for the foot that securely receives and positions the foot with respect to the sole assembly. In addition, the upper may have a configuration that protects the foot and provides ventilation, thereby cooling the foot and removing perspiration. The sole assembly is secured to a lower portion of the upper and is generally positioned between the foot and the ground. In addition to attenuating ground reaction forces (i.e., imparting cushioning), the sole assembly may provide traction and control foot motions, such as pronation. Accordingly, the upper and the sole assembly operate cooperatively to provide a comfortable structure that is suited for a variety of ambulatory activities, such as walking and running.

The sole assembly of athletic footwear generally exhibits a layered configuration that includes a comfort-enhancing insole, a resilient midsole formed from a polymer foam material, and a ground-contacting outsole that provides both abrasion-resistance and traction. The midsole is the primary sole assembly element that imparts cushioning and controls foot motions. Suitable polymer foam materials for the midsole include ethylvinylacetate or polyurethane that compress resiliently under an applied load to attenuate ground reaction forces. Conventional polymer foam materials are resiliently compressible, in part, due to the inclusion of a plurality of open or closed cells that define an inner volume substantially displaced by gas. The polymer foam materials of the midsole may also absorb energy when compressed during ambulatory activities.

It is an object of the present invention to provide an article of footwear that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

The principles of the invention may be used to advantage to provide an article of footwear with a plate bisecting a support column that provides improved wear, while still providing sufficient flexibility. In accordance with a first aspect, an article of footwear includes an upper, a midsole secured to the upper, and a support assembly secured to the midsole. The support assembly includes a top plate, a bottom plate, and a plurality of elastomeric support columns secured to the top plate and the bottom plate. The bottom plate extends through at least one of the support columns such that at least a portion of the respective support column extends outwardly from the bottom plate. An outsole is secured to the bottom plate.

In accordance with another aspect, an article of footwear includes an upper and a midsole secured to the upper. A support assembly is secured to the midsole. The support assembly includes a top plate, a bottom plate, and a plurality of elastomeric support columns secured to the top plate and the bottom plate. The bottom plate extends through a rearmost lateral support column such that at least a portion of the rearmost lateral support column extends outwardly from the bottom plate. An outsole is secured to the bottom plate.

Substantial advantage is achieved by providing an article of footwear with a plate bisecting a support column. In particular, an article of footwear with a plate bisecting a support column can provide footwear with improved outsole wear capabilities while still providing significant flexibility from the support columns.

These and additional features and advantages of the invention disclosed here will be further understood from the following detailed disclosure of certain preferred embodiments.

Figure 1:
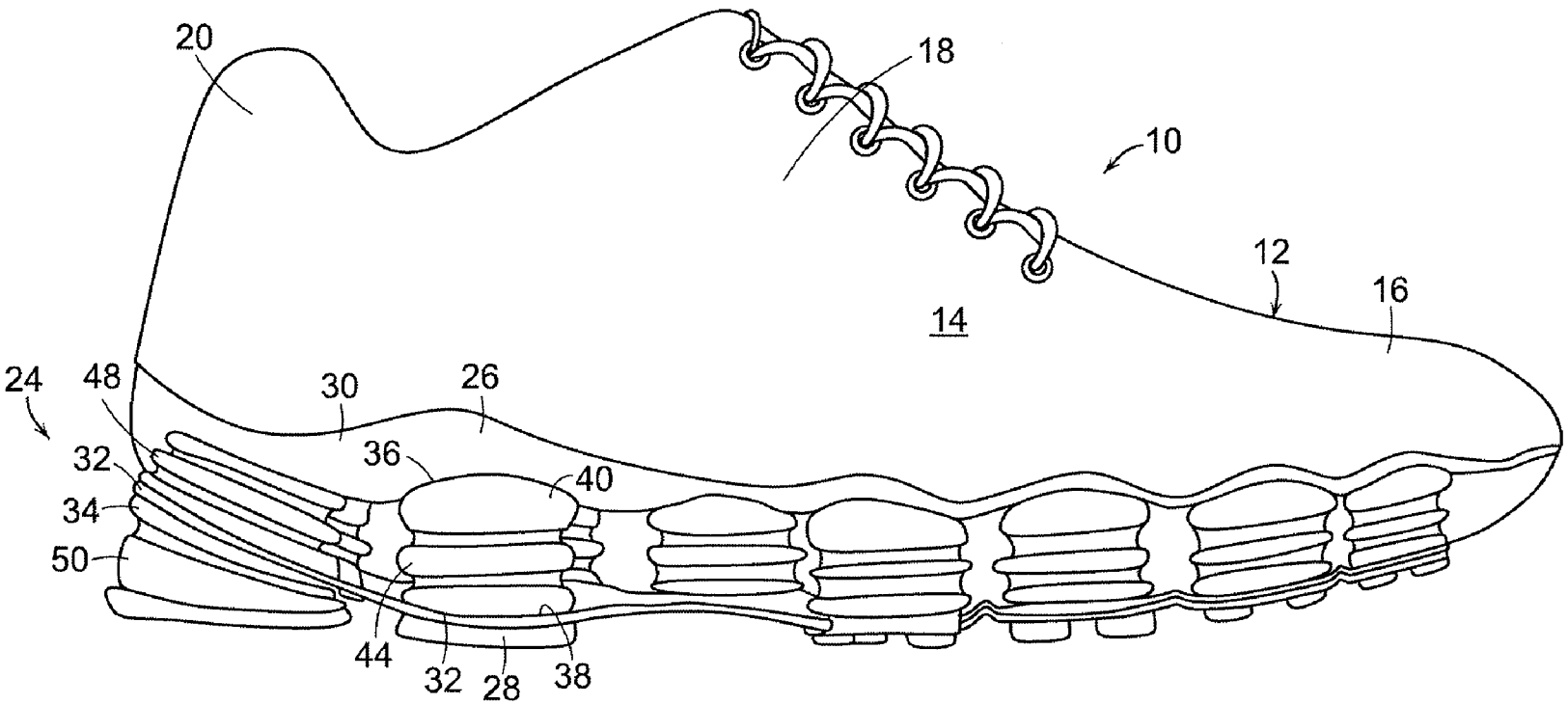
FIG. 1 is a side elevation view of an article of footwear in accordance with a preferred embodiment of the present invention.

The figures referred to above are not drawn necessarily to scale and should be understood to provide a representation of the invention, illustrative of the principles involved. Some features of the an article of footwear with a plate bisecting a support column depicted in the drawings have been enlarged or distorted relative to others to facilitate explanation and understanding. The same reference numbers are used in the drawings for similar or identical components and features shown in various alternative embodiments. Articles of footwear with a plate bisecting a support column as disclosed herein would have configurations and components determined, in part, by the intended application and environment in which they are used.

DETAILED DESCRIPTION OF CERTAIN PREFERRED EMBODIMENTS

Figure 2:
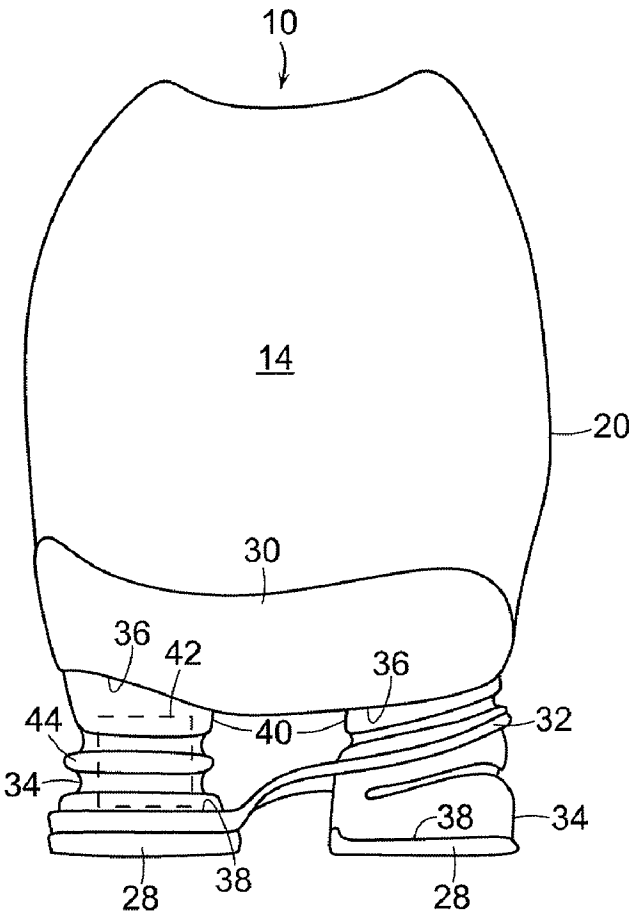
FIG. 2 is a rear elevation view of the article of footwear of FIG. 1.
Figure 3:
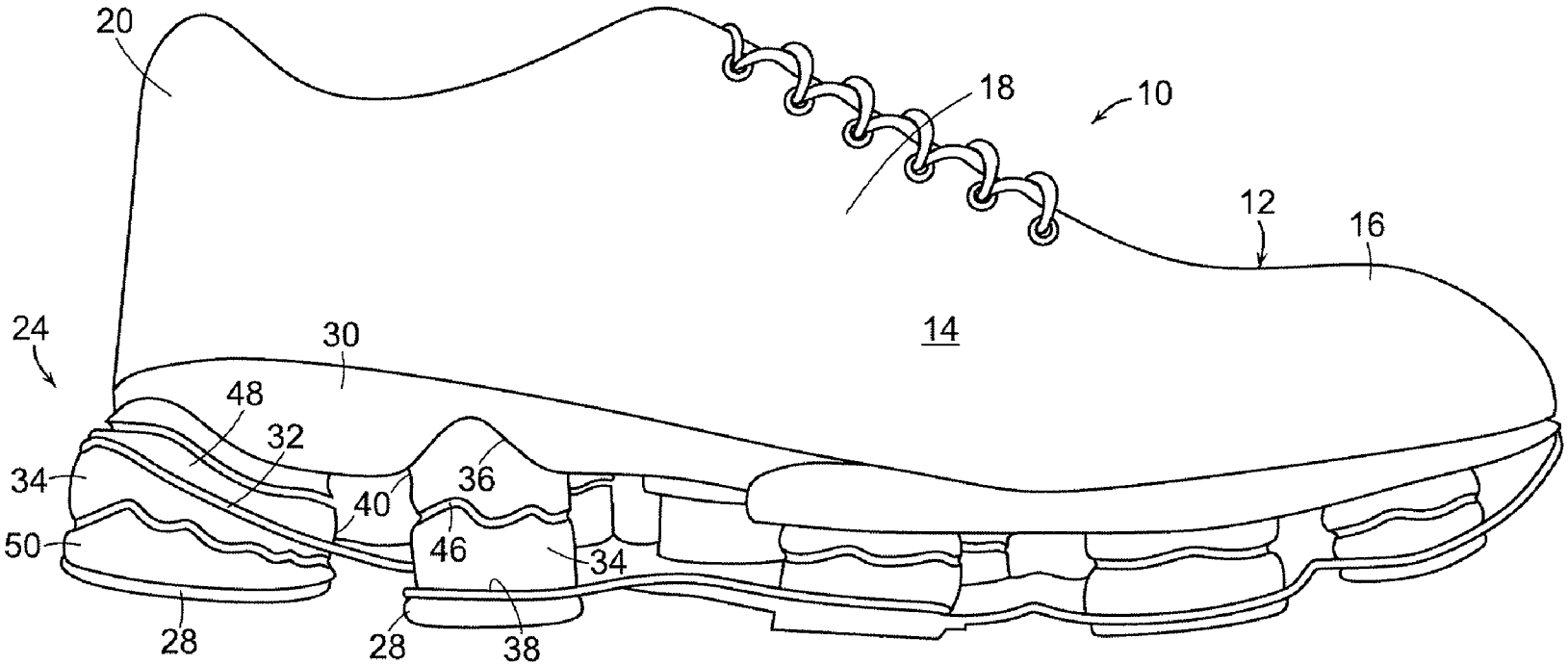
FIG. 3 is a side elevation view of an alternative embodiment of an article of footwear in accordance with the present invention.

The present invention may be embodied in various forms. A preferred embodiment of an article of footwear 10 is shown in FIGS. 1-3. Footwear 10 has a medial, or inner, side 12 and a lateral, or outer, side 14. For purposes of general reference, footwear 10 may be divided into three general portions: a forefoot portion 16, a midfoot portion 18, and a heel portion 20. Portions 16, 18, and 20 are not intended to demarcate precise areas of footwear 10. Rather, portions 16, 18, and 20 are intended to represent general areas of footwear 10 that provide a frame of reference during the following discussion. The figures illustrate only the article of footwear intended for use on the right foot of a wearer. One skilled in the art will recognize that a left article of footwear, such article being the mirror image of the right, is intended to fall within the scope of the present invention.

Unless otherwise stated, or otherwise clear from the context below, directional terms used herein, such as rearwardly, forwardly, inwardly, downwardly, upwardly, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 20, that is, to the left as seen in FIG. 1. Naturally, forwardly is toward forefoot portion 16, that is, to the right as seen in FIG. 1, and downwardly is toward the bottom of the page as seen in FIG. 1. Inwardly is toward the center of footwear 10, and outwardly is toward the outer peripheral edge of footwear 10.

Footwear 10 includes an upper 22, and a sole assembly 24 secured to upper 22. Sole assembly 24 may be secured to upper 22 by an adhesive, or any other suitable fastening means. Upper 22 receives and comfortably secures footwear 10 to a foot of a wearer. Sole assembly 24, which is generally disposed between the foot of the wearer and the ground, provides attenuation of ground reaction forces (i.e., imparting cushioning), traction, and may control foot motions, such as pronation. As with conventional articles of footwear, sole assembly 24 includes an insole (not shown) located within upper 12, a midsole 26, and an outsole 28. Midsole 26 is attached to upper 22 and functions as the primary shock-attenuating and energy-absorbing component of footwear 10. Outsole 28 is attached to the lower surface of midsole 26 and is preferably formed of a stiff material, providing support for the runner's foot in the sprinting position. Suitable materials for outsole 28 include polymers, e.g., polyether-block copolyamide polymers (sold as Pebax® by ATOFINA Chemicals of Philadelphia, Pa.), and nylon resins such as Zytel®, sold by Dupont. Other suitable materials for outsole 28 will become readily apparent to those skilled in the art, given the benefit of this disclosure.

Midsole 26 comprises a top plate 30, a bottom plate 32 and a plurality of compressible support columns 34 disposed between top plate 30 and bottom plate 32. Outsole 28 comprises a plurality of individual pieces, each secured to a lower surface of bottom plate 32. Each support column 34 includes an upper surface 36 that is attached to top plate 30, a lower surface 38 that is attached to bottom plate 32, and an exposed exterior surface 40 that extends between upper surface 36 and lower surface 38. Upper surface 36 may be secured to top plate 30 and lower surface 38 may be secured to bottom plate 32 by an adhesive.

As depicted in FIGS. 1-4, some support columns 34 have a generally cylindrical configuration. In certain embodiments, as depicted in FIG. 5, the rearmost laterally outward support column has a generally tear-drop cross-section, with its narrow end pointing inwardly and forwardly. Within the scope of the present invention, however, support columns 34 may have a variety of other columnar configurations including oval, pyramidal, cubic, conic, or any other regular geometric shape. In addition to regular shapes, support columns 34 may have an irregular geometric shape. Accordingly, support columns 34 may have a variety of configurations that perform the functions described herein. Suitable materials for support columns 34 include rubber, polyurethane foam, microcellular elastomeric foams, or phylon (EVA foam). Other suitable materials for support columns 34 will become readily apparent to those skilled in the art, given the benefit of this disclosure.

Support columns 34 serve to attenuate shocks and absorb energy as footwear 10 contacts the ground. One or more support columns 34 may include an interior void 42, as illustrated in FIG. 2. Each support column 34 may also include a plurality of physical features, including a smooth surface, circumscribing ridges, one or more circumscribing indentations, one or more circumscribing indentations that include one or more ribs, rings, or indicia, as disclosed in commonly owned U.S. Pat. Nos. 5,353,523 and 5,343,639 to Kilgore et al., the entire disclosures of which are incorporated herein by reference.

In embodiment illustrated in FIGS. 1-2, support columns 34 include a circumferential rib 44 on exterior surface 40. The compliance of each support columns 34 may be altered by repositioning rib 44. For example, each support columns 34 may be configured for greatest compliance by positioning rib 44 adjacent either upper surface 36 or lower surface 38. The least amount of compliance is achieved by centrally-locating rib 44, as depicted in midfoot and forefoot portions 18, 16 of FIG. 1. By altering the compliance of support columns 34, an individual may configure footwear 10 to have proper shock attenuation and energy absorption for the particular weight of the individual.

Figure 4:
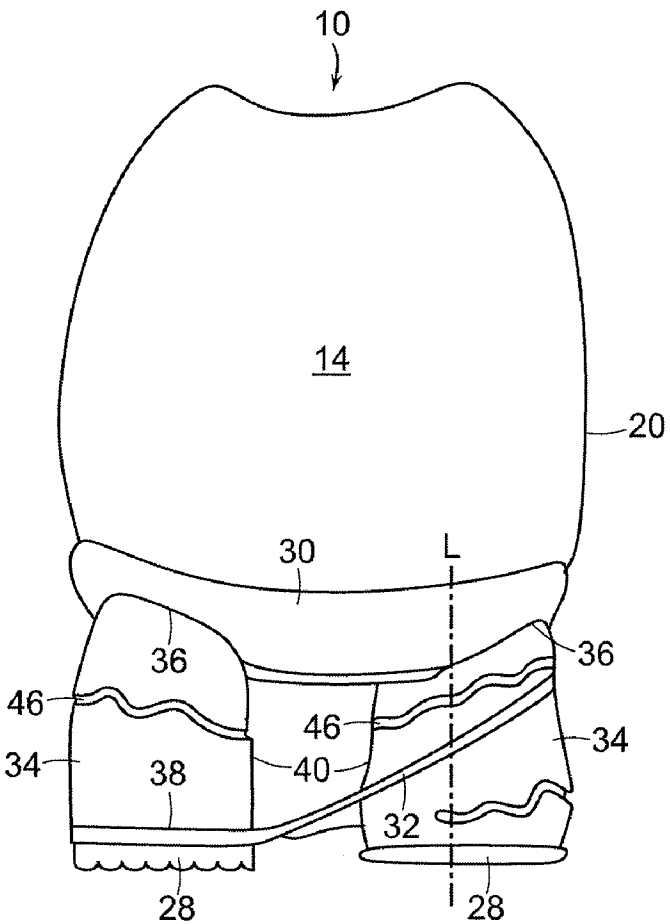
FIG. 4 is a rear elevation view of the article of footwear of FIG. 3.
Figure 5:
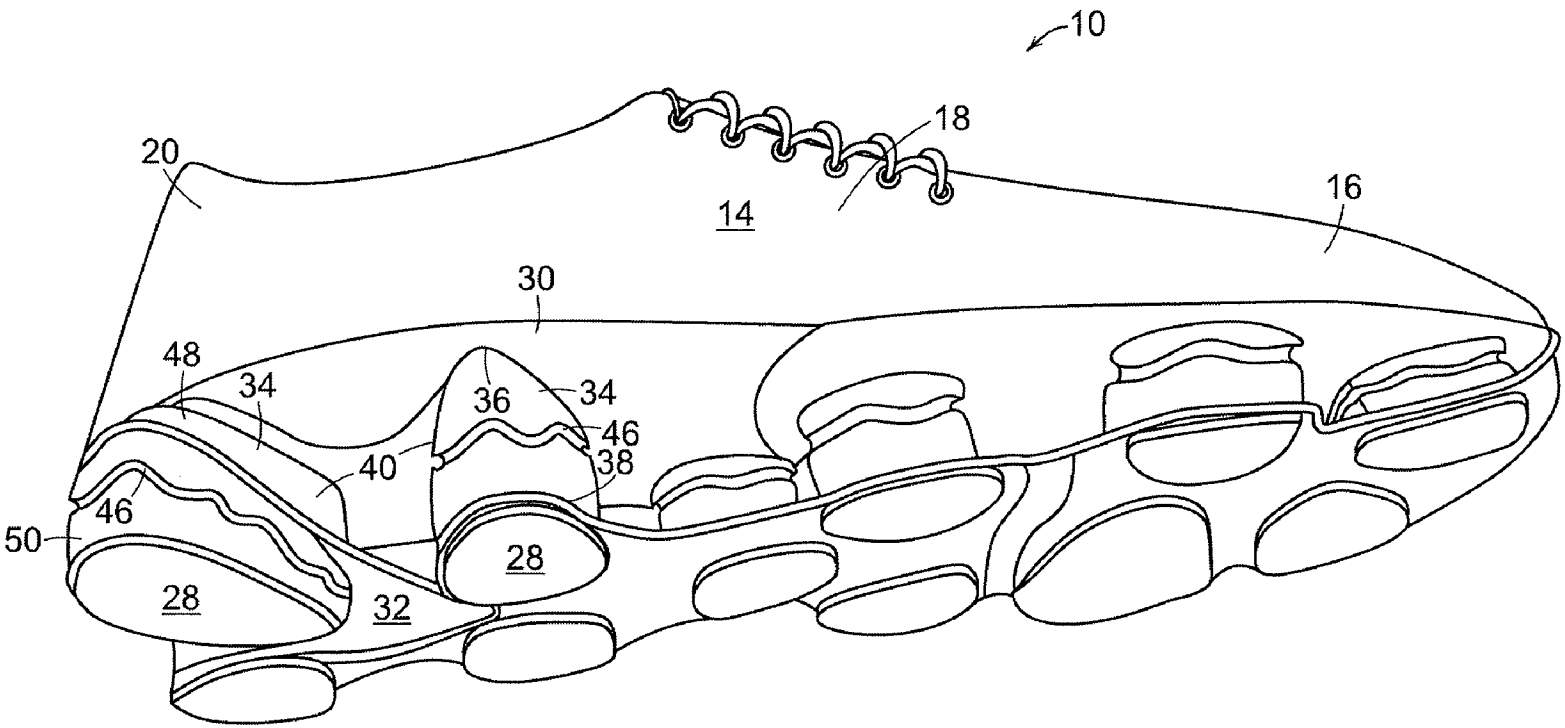
FIG. 5 is a perspective view of the article of footwear of FIG. 3.

In other preferred embodiments, as illustrated in FIGS. 3-5, support columns 34 include a circumferential groove 46 on exterior surface 40. As illustrated here, grooves 46 undulate up and down as they encircle support columns 34. The compliance of each support column 34 may be altered by repositioning groove 46. For example, each support columns 34 may be configured for greatest compliance by positioning groove 46 adjacent either upper surface 36 or lower surface 38. The least amount of compliance is achieved by centrally-locating groove 46, as depicted in midfoot and forefoot portions 18, 16 of FIG. 3. By altering the compliance of support columns 34, footwear 10 can be configured differently to have proper shock attenuation and energy absorption for individuals of different weights.

In certain preferred embodiments, bottom plate 32 extends through at least one support column 34, forming a first portion 48 and a second portion 50 of support column 34. Bottom plate 32 serves to maintain the orientation of support column 34 relative to the other columns when loaded during running or other activities. The bottom plate 32 extending through at least one support column, but less than all of the support columns, to divide each support column through which the bottom plate extends into a first portion and a second portion.

As illustrated in FIGS. 1-5, bottom plate 32 extends through the rearmost laterally outward support column 34. First portion 48 of support column 34 extends between upper plate 30 and bottom plate 32 and second portion 50 extends outwardly from bottom plate 32, with a portion of outsole 28 secured to second portion 50. First portion 48 and second portion 50 may be formed of the same or different materials. The materials used to form first portion 48 and second portion 50 may vary from very soft foam products to rigid solid materials. Suitable materials for first portion 48 and second portion 50 will become readily apparent to those skilled in the art, given the benefit of this disclosure.

In a preferred embodiment bottom plate 32 is curved downwardly and inwardly from the rearmost laterally outward corner of heel portion 20, that is, from the rear lateral corner of heel portion 20 toward the medial midfoot portion 18 of footwear 10, as seen in FIGS. 1-5. Bottom plate 32 may be molded to include this curve, or the curve can be formed during the assembly process. The curve in bottom plate 23 provides a smooth transition of forces in footwear 10. The typical motion of the foot during running proceeds as follows: First, the heel strikes the ground, followed by the ball of the foot. As the heel leaves the ground, the foot rolls forward such that the toes make contact, and finally the entire foot leaves the ground during toe-off, or launch to begin another cycle. While in contact with the ground, the foot typically rolls from the outside or lateral side to the inside or medial side, a process called pronation. That is, normally the outside of the heel strikes first and the toes on the inside of the foot leave the ground last. While the foot is airborne and preparing for another cycle, the opposite process, called supination, occurs. Thus, the curve of bottom plate 32 in heel portion 20 follows the typical motion of the user's foot during running. In other embodiments, bottom plate 32 may be simply angled with respect to a longitudinal axis L (shown in FIG. 4) of the respective support column 34 from lateral side 14 toward medial side 12, from heel portion 20 toward forefoot portion 16, or both.

By positioning bottom plate 32 such that it passes through one or more support columns 34, thereby dividing it into two portions, rigidity can be added to the support columns, while still providing flexibility for the columns. Bottom plate 32 may be formed of a variety of materials, including molded rubber, composite materials, and engineered fabrics. In certain preferred embodiments, bottom plate 32 may be formed of a multi-layer film, or a single-layer film. Bottom plate 32 may be a thermal formed plate, formed by, for example, vacuum forming, injection molding, blow molding, or rotational molding.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. An article of footwear comprising, in combination:
an upper; and
a support assembly secured to the upper, the support assembly comprising
a top plate;
a bottom plate; and
a plurality of elastomeric support columns secured to the top plate and the bottom plate, the bottom plate extending through at least one support column, but less than all of the support columns, to divide each support column through which the bottom plate extends into a first portion and a second portion.

2. The article of footwear of claim 1, wherein the bottom plate extends through the at least one support column at an angle with respect to a longitudinal axis of the respective support column.

3. The article of footwear of claim 2, wherein the respective support column through which the bottom plate extends is positioned at a rear lateral corner of the support assembly.

4. The article of footwear of claim 2, wherein the bottom plate is angled downwardly from a rear side of the respective support column toward a forward side of the respective support column.

5. The article of footwear of claim 2, wherein the bottom plate is angled downwardly from a lateral side of the respective support column toward a medial side of the respective support column.

6. The article of footwear of claim 1, wherein the bottom plate is curved downwardly and inwardly from a rear lateral corner toward a medial midfoot portion of the support assembly.

7. The article of footwear of claim 1, wherein at least one support column includes a groove formed in its exterior surface.

8. The article of footwear of claim 7, wherein the groove extends about a circumference of the support column.

9. The article of footwear of claim 7, wherein the groove undulates and extends about a circumference of the support column.

10. The article of footwear of claim 1, wherein at least one support column includes a central void.

11. The article of footwear of claim 1, wherein an exterior surface of at least one support column includes a circumferential rib.

12. The article of footwear of claim 1, wherein at least one support column is formed of one of rubber, polyurethane foam, microcellular elastomeric foams, and EVA foam.

13. The article of footwear of claim 1, wherein the first portion is formed of a first material and the second portion is formed of a second material.

14. The article of footwear of claim 1, further comprising a midsole positioned between the upper and the support assembly.

15. The article of footwear of claim 1, wherein the support assembly comprises a plurality of elastomeric support columns.

16. The article of footwear of claim 1, further comprising an outsole secured to the support assembly.

17. An article of footwear comprising, in combination:
an upper;
a midsole secured to the upper;
a support assembly secured to the midsole, the support assembly comprising
a top plate;
a bottom plate; and
a plurality of elastomeric support columns secured to the top plate and the bottom plate, the bottom plate extending through a rearmost lateral support column such that at least a portion of the rearmost lateral support column extends outwardly from the bottom plate, the bottom plate extending through less than all of the support columns; and
an outsole secured to the bottom plate.

18. The article of footwear of claim 17, wherein at least one support column includes a groove formed in its exterior surface.

19. The article of footwear of claim 18, wherein the groove extends about a circumference of the support column.

20. The article of footwear of claim 18, wherein the groove undulates and extends about a circumference of the support column.

21. The article of footwear of claim 17, wherein at least one support column includes a central void.

22. The article of footwear of claim 17, wherein an exterior surface of at least one support column includes a circumferential rib.

23. The article of footwear of claim 17, wherein at least one support column is formed of one of rubber, polyurethane foam, microcellular elastomeric foams, and EVA foam.

24. An article of footwear comprising, in combination:
an upper;
a midsole secured to the upper;
a support assembly secured to the midsole, the support assembly comprising
a top plate;
a bottom plate; and
a plurality of elastomeric support columns secured to the top plate and the bottom plate, the bottom plate extending through at least one support column, but less than all of the support columns, to divide each support column through which the bottom plate extends into a first portion and a second portion; and
an outsole secured to the support assembly.

* * * * *